United States Patent [19]

Balogh et al.

[11] Patent Number: 5,032,098

[45] Date of Patent: Jul. 16, 1991

[54] ILLUMINATED FLYING DISK

[75] Inventors: John M. Balogh; Eugene H. Smith, both of Chicago, Ill.

[73] Assignee: Eugene H. Smith and Associates, Chicago, Ill.

[21] Appl. No.: 517,220

[22] Filed: May 1, 1990

[51] Int. Cl.[5] ..... A63H 27/00

[52] U.S. Cl. ..... 446/47; 273/424

[58] Field of Search ..... 446/46, 47, 48, 219, 446/484, 485; 273/424, 425

[56] References Cited

U.S. PATENT DOCUMENTS

| | | | |
|---|---|---|---|
| 3,610,916 | 10/1971 | Meehan | 446/485 X |
| 3,786,246 | 1/1974 | Johnson et al. . | |
| 3,812,614 | 5/1974 | Harrington | 446/47 |
| 4,132,031 | 1/1979 | Psyras | 446/47 |
| 4,307,538 | 12/1981 | Moffitt | 446/47 |
| 4,383,244 | 5/1983 | Knauff . | |
| 4,563,160 | 1/1986 | Lee | 446/47 |
| 4,778,428 | 10/1988 | Wield | 446/485 X |

*Primary Examiner*—Robert A. Hafer
*Assistant Examiner*—Sam Rimell
*Attorney, Agent, or Firm*—Hill, Van Santen, Steadman & Simpson

[57] ABSTRACT

An illuminated flying disk includes a plurality of light emitters mounted in a flying disk toy as well as a control circuit mounted in a centrally disposed circuit housing on the underside of the disk. A cap for the control circuit housing is rotatable to provide a simple yet rugged switch for selectively supplying power to the light emitters.

16 Claims, 2 Drawing Sheets

ILLUMINATED FLYING DISK

BACKGROUND OF THE INVENTION

1. Field of the Invention

The present invention relates generally to a flying toy disk and the like and, more particularly, to a flying toy disk having light emitters mounted in the disk.

2. Description of the Related Art

An illuminated flying saucer is disclosed in U.S. Pat. No. 3,786,246 in which a "Frisbee" type flying disk is provided with an accessory including a central container with three arms each containing a miniature electric lamp. A hole is formed in the rim of the disk for passage of the light from the lamp. Dry cell batteries are mounted in the container as a power source for the lamps, and a miniaturized switch is provided to complete the circuit. An alternate embodiment has the electric lamps incorporated directly into the rim.

U.S. Pat. No. 3,812,614 discloses a rotatable stroboscopic toy in which light emitting diodes mounted in the periphery connected to a multivibrator electronic drive circuit. The drive circuit includes a six to nine volt battery and a linear integrated circuit.

A pseudo multi light display device and generator therefor is disclosed in U.S. Pat. No. 4,383,244 in which light emitting diodes are intermittently energized while in motion to appear a dots and bars when set in rotary motion. In the preferred embodiment, a disc containing the light emitting diodes and a variable pulse generator is affixed to the wheel of a skate.

SUMMARY OF THE INVENTION

An object of the present invention is to provide a simple yet durable switch for an illuminated flying disk.

Another object of the invention is to provide a light weight control circuit and power source for an illuminated flying disk.

A further object of the invention is to provide an inexpensive and simple to manufacture flying disk that is fun to use, both during the day as well as at night.

These and other objects and advantages of the present invention are achieved in an illuminated flying disk having a disk shaped body with a convex top surface and a concave lower surface, the lower surface being provided with a housing for a control circuit, the housing also serving as a switch for selectively supplying power to light emitters in the disk.

In particular, the disk shaped body is of conventional design for a Frisbee type throwing disk. The top surface is convex to provide lift as the disk moves through the air, and in an exemplary embodiment is provided with a gradual step spaced radially inwardly from the edge of the disk. The gradual step separates a substantially flat central portion from the annular outer portion and provides improved grasping contours for the disk as it is being thrown. The outermost edge of the disk is provided with a downwardly projecting rim that encircles the concave underside of the disk.

The outermost edge of the disk at the rim is provided with recesses and within each of the recesses is mounted a lamp. The gradual step also has recesses formed therein, each with a lamp. In an exemplary embodiment, two recesses are in the rim of the disk and two recesses are in the gradual step, above the recesses in the rim. Since the disk should be balanced to fly and spin properly, the recesses are diametrically opposed on the disk. By providing parabolic shaped recesses with the lamps mounted in the center, the recesses provide a wide angle of view for each of the lamps and act somewhat as reflectors.

The lamps in the recesses are light emitting diodes, which shine brightly while using little power. Light emitting diodes, also known as LEDs, are available in a variety of colors, and it is contemplated to use a combination of different color LEDs in the disk. The lamps are easily mounted in the disk by forming a small hole through the disk from the underside at each recess and inserting one of the lamps in the hole. The end of the lamp should not extend beyond the outer surface of the disk, or the lamp will be too easily knocked loose during throwing and catching.

Turning the disk over to view the underside reveals a centrally mounted cylinder with covered channels extending from the cylinder to the outer edge. Within the central cylinder is a control circuit, a battery power supply, and a switch of simple yet rugged construction, while the covered channels enclose wires supplying power to the lamps. The number and placement of the covered channels corresponds to the number and arrangement of the lamps in the disk. The covered channels of the exemplary embodiment each include a pair of parallel ridges with the wires lying between the ridges and a covering affixed to enclose the space between the ridges. The coverings for the channels are strips that are attached by heat welding or ultrasonic welding. An additional possibility is to embed the wiring in the material of the disk, or to apply a conductive film to carry power to the lamps.

The central cylinder on the underside of the disk is short and wide and includes a fastener at the center point which holds on a cap. The fastener is a screw, although other types of preferably releasable fasteners may also be used. For example, a post having an enlarged free end may be snap fitted through an opening in the cap of the central cylinder. The cap may be turned about the fastener in, for example, quarter turn increments.

Removing or releasing the fastener reveals a compartment formed by an annular wall on the underside of the disk, the cap being fastened over the annular wall. Within the compartment is the control circuit mounted on a small circuit board having battery contact locations formed on the circuit board. Several batteries, in the exemplary embodiment four batteries, rest on the battery contact locations on the circuit board. The batteries are small, light, camera-type batteries, and are arranged symmetrically in the compartment for balanced flight of the disk.

On the inside of the cap is at least one conductive area which may be moved to connect two terminals of the batteries when the cap is rotated to a first position. By connecting the battery terminals, the control circuit is completed. Of course, further rotation of the cap moves the conductive area out of electrical contact with the batteries and opens the circuit. The cap, thus, forms the switch for controlling the supply of power to the lamps. To provide durability and shock resistance, the inside of the cap is provided with an annular disk of elastomeric material, such as a foam, over which is provided a film, such as of acetate. The conductive areas are silk screened metal foil on the surface of the film, or for a simpler and less expensive conductive area, staples are applied in the foam.

The cap has detents for positional determination. For example, the edge or rim of the cap has flanges around a portion thereof which coact with projections on the underside of the disk to "click" into place when the cap is rotated to the "on" position and to "click" into place when the cap is rotated to the "off" position. The switch is unidirectional and may be rotated in either direction for the on or off position. The switch is thus simple to use and to manufacture, as well as inexpensive and rugged.

The control circuit for the exemplary embodiment pulses power to the lamps for a strobing effect. Preferably the strobing of the lamps is rapid enough so that the lamps appear to be constantly lit when stationary, but provide a dramatic display of multiple lamps when the disk is rotated. For example, pulsing the lamps at 50 Hz. results in the disk appearing to have tens of lamps distributed about the entire circumference of the disk when the disk is thrown, producing an exciting night time display.

DESCRIPTION OF THE PREFERRED EMBODIMENTS

Figure 1:
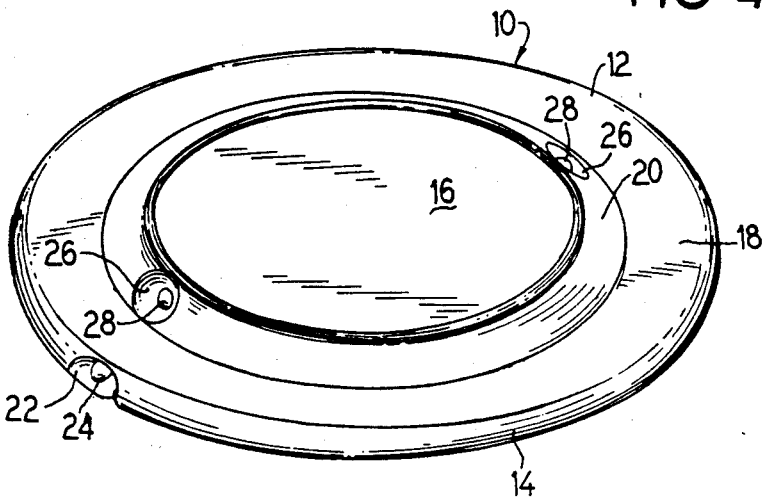
FIG. 1 is a perspective view of the illuminated flying disk according to the principles of the present invention.

In FIG. 1 is shown the illuminated flying disk 10 of the present invention. The flying disk is a Frisbee type toy disk having a convex top surface 12 and a downwardly extending rim 14. In the illustrated example, a central portion 16 of the top surface 12 is relatively flat for the application of logo or the like and is separated from an outer annular edge 18 by a gradual step 20.

On diametrically opposed edges of the rim 14 are provided recesses 22 within each of which is mounted a lamp 24 that, in the preferred embodiment, is an LED, or light emitting diode. Recess 26 with LEDs 28 mounted therein are provided on the diametrically opposed surfaces of the gradual step 20. In the example of FIG. 1, the recesses 26 are disposed above the recesses 22.

Figure 2:
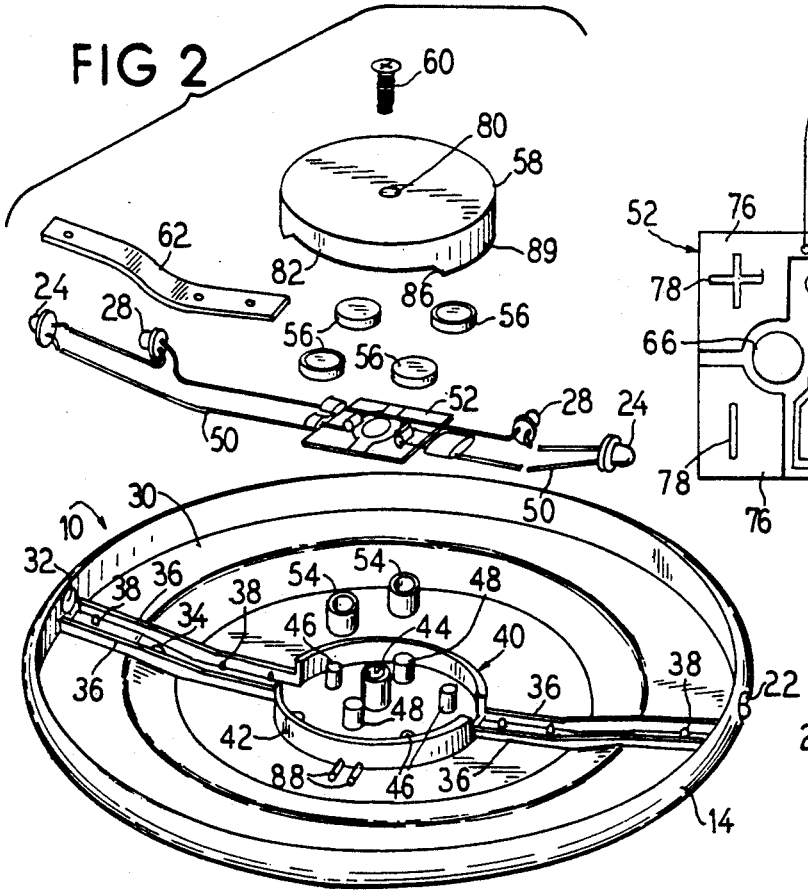
FIG. 2 is an exploded view of the underside of the flying disk of FIG. 1.

Referring to FIG. 2, the disk 10 has a concave underside surface 30 of a shape generally corresponding to the shape of the top surface 12. At the recesses 22 in the rim 14 are provided holes 32 into which the LEDs 24 are mounted and, similarly, holes 34 are provided for the LEDs 28 on the gradual step 20.

Extending between the holes 32 and a center of the disk 10 is a pair of parallel ridges 36 between which are disposed heat welding pins 38. The parallel ridges 36 form wiring channels, and the channels extend to a circular control circuit housing 40 formed by an annular wall 42 extending upwardly from the underside surface 30 of the disk 10. Auxiliary ridges 88 are also provided as will be discussed hereinafter. The channels formed by the ridges 36 are each closed by a strip 62, only one of which is shown in FIG. 2 for purposes of simplifying the drawing. Within the control circuit housing 40 is a center post 44 having a central threaded bore extending thereinto and six smaller pins 46 and 48.

In the exploded view of FIG. 2, the LEDs 24 and 28 are shown connected via wiring harnesses 50 to a circuit board 52 containing the control circuit of the present invention. The circuit board 52 is held in the control circuit housing 40 by a pair of sleeves 54 which slide over the pins 48 after the circuit board 52 is mounted in place. The sleeves 54 hold the circuit board in position during use of the disk. Resting on top of the circuit board 52 in the control circuit housing 40 are four camera type batteries 56, and the control circuit housing is closed by a cap 58 which is held in place by a screw 60.

Figure 3:
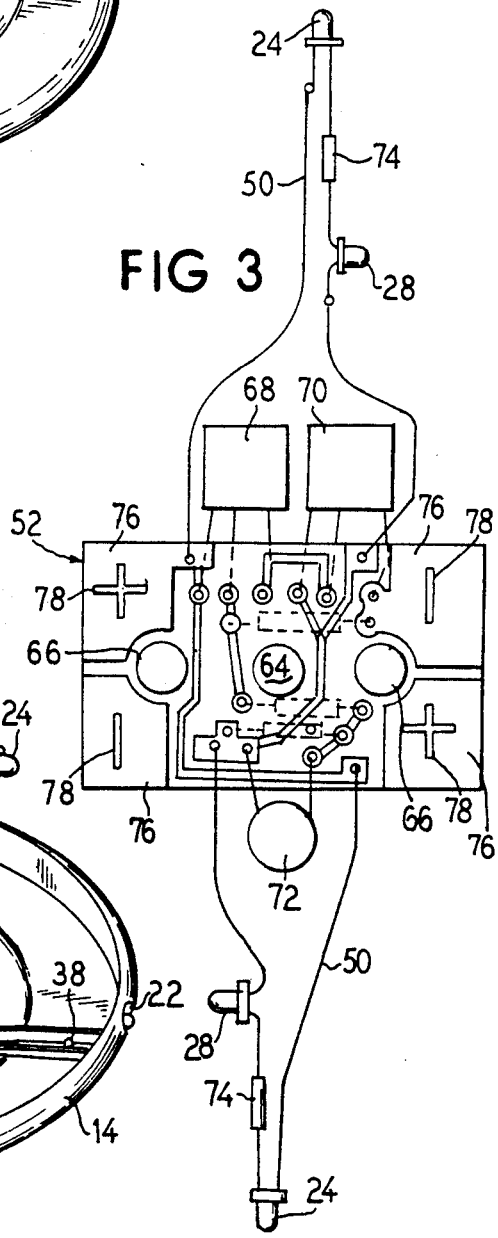
FIG. 3 is a plan view of the control circuit and lamp wiring harness for the embodiment of the flying disk shown in FIG. 2.

Referring to FIG. 3, the circuit board 52 is provided with a central hole 64 and side holes 66. The central hole 64 receives the center post 44 while the side holes 66 receive the pins 48 in the control circuit housing 40. The pins 46 engage the outside edges of the circuit board 52 as well a the batteries 56. On the circuit board 52 are mounted a number of electrical components, depending upon the control circuit used. In particular, first and second transistors 68 and 70 and a capacitor 72 are provided on the circuit board 52, along with several resistors. The wiring harnesses 50 are also connected to the circuit board 52, which wiring harnesses 50 include not only the LED lamps 24 and 28, but also wire connectors 74.

On the surfaces of the circuit board 52 is found a pattern of leads or traces which remain after the etching of the circuit board and serve to connect the various components of the control circuit. On the four corners of the circuit board 52 are battery contact surfaces 76 which are exposed metal surfaces upon which the batteries 56 rest. The battery contacts 76 are formed during etching of the circuit board by leaving the corner portions thereof unetched. To insure proper installation of the batteries 56, the battery contact surfaces 76 are provided with polarity markings 78. With the circuit board 52 mounted in the control circuit housing 40, each battery 56 rests on one of the battery contact surfaces 76 and is retained in position in the control circuit housing 40 by resting between the wall 42, one of the pins 46, and one of the sleeves 54 about the pins 48. The batteries 56 are thus restrained from lateral movement within the housing 40.

Figure 4:
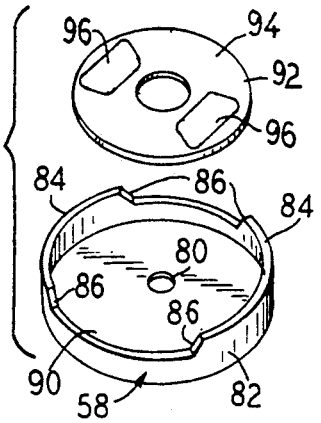
FIG. 4 is an exploded view of the switch cap of the illuminated flying disk of FIG. 2.

In FIG. 4 is shown the cap 58 in an inverted position and having a central opening 80 through which the center post 48 and the screw 60 extends. The outer edge of the cap 58 includes a flange 82 having two extended flange portions 84 on opposite sides thereof. The extended flange portions 84 have ramped surfaces 86 at their opposite ends. The arcuate length of the flange extensions 84 corresponds to the distance between an adjacent one of the ridges 36 and an auxiliary ridge 88 on the under side of the disk 10, as shown in FIG. 2. The ramped surfaces 86 permit the cap 58 to be rotated on the control circuit housing 40 by causing the extended flange portions 84 to move up and over the ridges 36 and 88. The cap 58 then moves into a detent or click position at each quarter turn thereof as the extended flange portions 84 move to between the ridges 36 and 88. The cap 58 can be rotated in either direction.

Mounted on an inside surface 90 of the cap 58 is an annular body 92 of a flexible material, such as foam. On the top surface of the foam body 92 is provided a plastic film 94 of, for example, acetate. The film 94, and preferably the foam 92, are nonconductive. A pair of conductive regions 96 are formed on the film 94 by, for example, silk screening a thin layer of metal onto the film. When moved into a first position by the rotation of the cap 52, the conductive regions 96 each span the terminals of two adjacent batteries 56 to complete the electrical control circuit and thereby apply power to the LED lamps 24 and 28. When moved to a second position one quarter turn from the first position, contact with the battery terminals is lost, and power is disconnected from the control circuit. A further improvement in the present device contemplates replacing the silk screened conductive regions 96 with simple metal staples applied in the foam body 92. Such staples (not shown) are more economical and easy to apply than the metal film.

Figure 5:
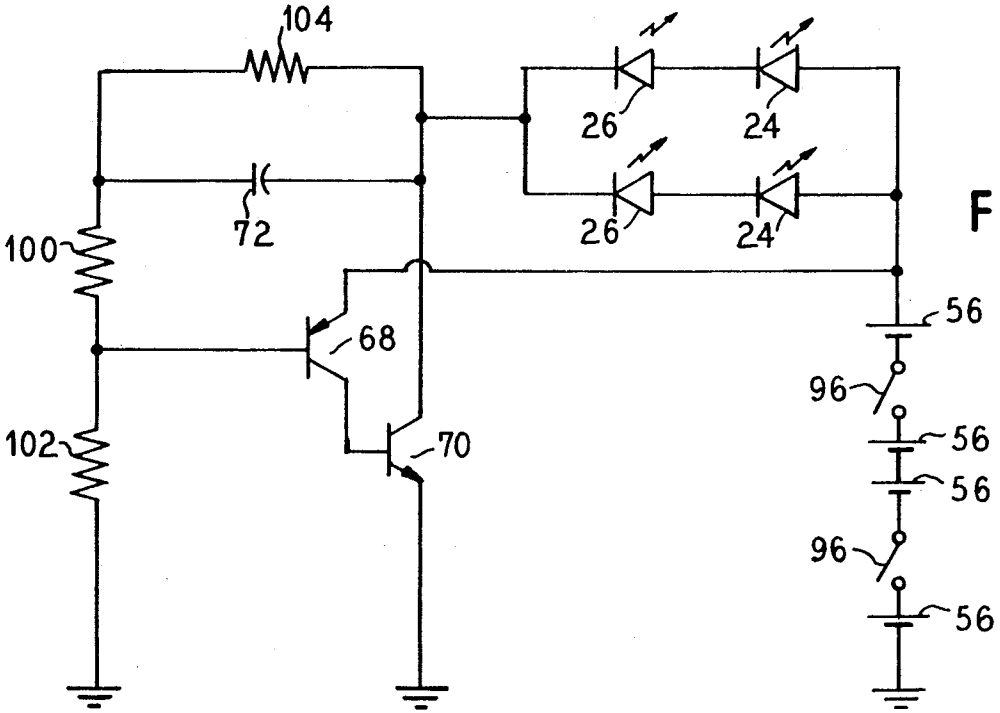
FIG. 5 is a circuit diagram of the control circuit for the present illuminated flying disk.

The control circuit for the present invention, as shown in FIG. 5, is a fast pulse Schmitt trigger or relaxed oscillator which produces pulses of very short duration for supply to the LED lamps. For extended battery life, it is preferred that the pulses have a short duty cycle. Briefly, the control circuit operates when the switches 96, which are the conductive areas on the cap 58, are in a closed position in contact with the terminals of two adjacent batteries. With the switches 96 closed, current flows through the LEDs 24 and 26 to charge the capacitor 72. When the capacitor 72 reaches a predetermined charge level, insufficient voltage is across the LEDs 24 and 28 so that the LEDs no longer emit light. When the capacitor 72 has reached a sufficiently charged state, the voltage at the base of the transistor 68, through the voltage divider network formed by the resistors 100 and 102 and the resistor 104, causes the transistor 68 to switch to a conductive state. This causes the transistor 72 to likewise switch to a conductive state. The switching of the transistor 70 to a conductive state briefly effectively grounds the right terminal of the capacitor 72 to discharge some of the voltage across the capacitor 72. This simultaneously establishes a path to ground for the diode bank so that the diodes are briefly lit. The discharge of the capacitor 7 lowers the voltage at the base of the transistor 68 sufficiently to turn both the transistor 68 and the transistor 70 to a non-conductive or off state.

By selection of the appropriate component values for the illustrated circuit, very short pulses of power are applied to the LEDs to conserve battery life. Pulses in the radio frequency range are produced by the following circuit values:

C 72=0.02μF
R 104=8.2MΩ
R 100=33kΩ
R 102=5.1MΩ
Q 68=2N3906
Q 70=2N3904

Figure 6:
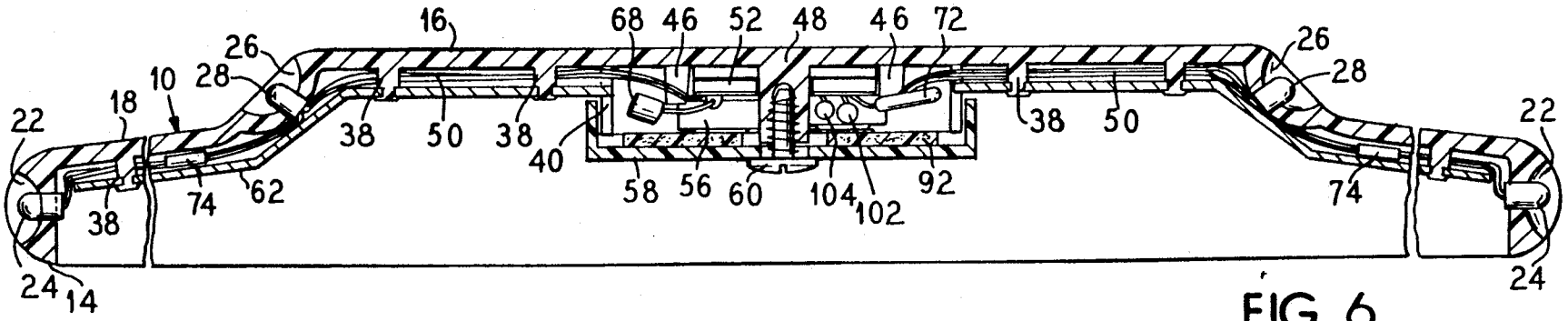
FIG. 6 is a cross section of the assembled illuminated flying disk of the invention.

The cross section of the flying disk 10 of FIG. 6 show the LEDs 24 and 28 in the recesses 22 and 26, respectively, which are parabolically shaped to provide a wide angle of view for the LEDs, serve as reflectors therefore, and place the LEDs back from the outside surface of the disk 10. The wiring harnesses 50 are sealed in the channels formed by the ridges 36 and covered by the straps 62. In the illustrated embodiment, the pins 38 extend through holes in the straps 62 and are heat welded. Alternately, the pins 38 may be eliminated and the strap 62 ultrasonically welded onto the ridges 36. In the center of the disk 10, the post 44 receives the screw 60 to hold the cap 58 over the control circuit housing 40. The cap 58 is rotatable about the post 44 to move the conductive areas 96 into and out of contact with the terminals of the batteries 56. The conductive areas 96 are formed on the film at the surface of the foam body 92 affixed to the inside of the cap 58. The foam not only serves as a base for the conductive areas 96, but also provides resilience to absorb shock to the control circuit and batteries during use of the present device. The resilient foam 92 presses the conductive areas downward on the terminals of the batteries 56, which in turn press downward on the circuit board 52 to hold everything securely together within the control circuit housing 40 and insure that electrical contact not lost. The components for the control circuit, including the transistors, resistors and capacitor are disposed between the batteries 56 in the housing.

Thus, there has been shown and described an illuminated flying disk of the present invention which is simple in construction yet durable and, moreover, is light in weight to provide stable and extended flight of the disk. The various elements of the present flying disk are arranged symmetrically to provide balanced flight, and the construction of the disk and the selection of the components has been with a mind to reducing weight and cost. The pulsed illuminated lamps in the light weight flying disk of the present invention enhance the fun during use of the disk during the daylight hours as well as at night.

Although other modifications and changes may be suggested by those skilled in the art, it is the intention of the inventors to embody within the patent warranted hereon all changes and modifications as reasonably and properly come within the scope of their contribution to the art.

We claim:

1. An illuminated flying disk, comprising:

a disk shaped body of a shape to provide lift when tossed;

at least one light emitter mounted in said disk shaped body;

at least one battery to provide power to said at least one light emitter;

a control circuit electrically connecting to said at least one light emitter and said at least one battery; and a housing mounted on said disk shaped body and enclosing said control circuit and said at least one battery, said housing forming a switch movable between a first position and a second position to selectively complete said control circuit to supply power to said at least one light emitter, wherein said housing is of a cylindrical shape having a first portion rotatably mounted relative to a second portions aid first portion carrying a movable electrical contact, said movable contact being in contact with a terminal of said at least one battery when said first portion of said housing is in said first position and being free of contact with said terminal of said at least one battery when said first portion of said housing is in said second position.

2. An illuminated flying disk as claimed in claim 1, further comprising:

means for indicating said first position of said housing and said second position of said housing.

3. An illuminated flying disk as claimed in claim 2, wherein said means for indicating includes:

a plurality of ridges on said disk shaped body; and a projection on said first portion of said housing for cooperative contact with ones of said plurality of ridges to form a detent.

4. An illuminated flying disk as claimed in claim 1, wherein said first portion of said housing is a cap rotatably affixed to said disk shaped body over said second portion of said housing, and said second portion of said housing is an annular wall extending from an underside of said disk shaped body.

5. An illuminated flying disk as claimed in claim 4, further comprising:

a disk of resilient foam affixed inside said cap of said first portion of said housing; and said movable electrical contact is at least one conductive member on said disk of resilient foam for selective contact with said at least one battery when said first portion is in said first position.

6. An illuminated flying disk as claimed in claim 1, wherein said housing is mounted on an underside of said disk shaped body.

7. An illuminated flying disk as claimed in claim 6, further comprising:

a channel formed on an underside of said body extending from said switch to said light emitter; and electrical wiring disposed in said channel and connecting said at least one light emitter to said control circuit.

8. An illuminated flying disk as claimed in claim 1, wherein said control circuit is mounted on a circuit board held within said housing.

9. An illuminated flying disk as claimed in claim 1, wherein said control circuit includes a means for transmitting pulses to said at least one light emitter.

10. An illuminated flying disk, comprising:

a disk shaped body of a resilient material having a convex upper side and a concave lower side, said disk shaped body having a plurality of first recesses formed in a perimeter edge and a plurality of second recesses formed in said convex upper side intermediate a center of said disk shaped body and said perimeter;

a cup shaped receptacle formed on said concave underside of said disk shaped body;

channels formed on said concave underside of said disk shaped body extending from said cup shaped receptacle to said first and second recesses;

a corresponding plurality of light emitters mounted in said first and second recesses;

a control circuit mounted in said cup shaped receptacle and having electrical wiring connected between said control circuit and said plurality of light emitters, said control circuit including a plurality of battery contacts;

a plurality of batteries mounted in said cup shaped receptacle in contact with respective ones of said battery contacts;

a switch mounted over said cup shaped receptacle, said switch including:

a cup shaped cap mounted for rotation over said cup shaped receptacle, a resilient member of non-conductive material mounted in said cup shaped cap, a predetermined area of electrically conductive material formed on said resilient member for selective contact with a terminal of at least one of said batteries, detent means between said cup shaped cap and said disk shaped body for indicating a first rotation position of said cup shaped cap relative to said body wherein said area of electrically conductive material is in contact with said terminal of said at least one battery to complete said electrical circuit and for indicating a second rotation position of said cup shaped cap relative to said body wherein said area of electrical conductive material is free of contact with said terminal of said at least one battery to open said electrical circuit.

11. An illuminated flying disk as claimed in claim 10, wherein said plurality of first recesses is two first recesses and wherein said plurality of second recess is two recesses.

12. An illuminated flying disk as claimed in claim 10, wherein said resilient member is annular in shape.

13. An illuminated flying disk as claimed in claim 10, wherein said area of electrically conductive material connects terminals of two of said plurality of batteries when said cap is in said first position.

14. An illuminated flying disk as claimed in claim 13, wherein said plurality of batteries is four batteries, and further comprising:

a second predetermined area of conductive material formed on said resilient member, said second predetermined area of conductive material connecting terminals of third and fourth ones of said batteries to one another when said cup shaped cap is in said first position.

15. An illuminated flying disk as claimed in claim 10, wherein said detent means includes at least one extension projecting from an edge of said cup shaped cap, and a projection on an underside of said body in contact with said at least one extension as said cup shaped cap is moved between said first position and said second position.

16. An illuminated flying disk as claimed in claim 15, wherein said at least one extension is two extensions on opposite sides of said cup shaped cap.

* * * * *